US005270484A

United States Patent [19]

Tsuchiya et al.

[11] Patent Number: 5,270,484

[45] Date of Patent: Dec. 14, 1993

[54] POWDER CONVEYING DEVICE

[75] Inventors: Hiroaki Tsuchiya; Keishi Ohsawa; Yuji Sakemi, all of Yokohama; Kenichiro Waki, Kawasaki; Nobuyuki Ito, Oume; Takehiro Takano, Sendai; Yoshiro Tomikawa, Yonezawa, all of Japan

[73] Assignee: Canon Kabushiki Kaisha, Tokyo, Japan

[21] Appl. No.: 757,638

[22] Filed: Sep. 11, 1991

[30] Foreign Application Priority Data

| | | | |
|---|---|---|---|
| Sep. 14, 1990 | [JP] | Japan | 2-242715 |
| Sep. 14, 1990 | [JP] | Japan | 2-242716 |
| Nov. 27, 1990 | [JP] | Japan | 2-320823 |
| Nov. 27, 1990 | [JP] | Japan | 2-320824 |

[51] Int. Cl.[5] ..... G03G 15/06

[52] U.S. Cl. ..... 118/653; 310/323; 355/245; 417/322

[58] Field of Search ..... 355/245, 253, 261, 262, 355/265, 259, 298; 118/653, 644; 310/323; 417/322, 413 A

[56] References Cited

U.S. PATENT DOCUMENTS

| | | | |
|---|---|---|---|
| 3,743,446 | 7/1973 | Mandroian | 310/323 X |
| 4,449,893 | 5/1984 | Beckman et al. | 417/322 |
| 4,499,479 | 2/1985 | Chee-Shuen Lee et al. | 310/369 X |
| 4,777,107 | 10/1988 | Kurematsu et al. | 130/122 |
| 4,794,878 | 1/1989 | Connors et al. | 118/653 |
| 4,808,084 | 2/1989 | Tsubouchi et al. | 310/328 X |
| 4,844,008 | 7/1989 | Sakemi et al. | 118/658 |
| 5,027,157 | 6/1991 | Hotomi et al. | 355/259 X |

FOREIGN PATENT DOCUMENTS 55-43258 3/1980 Japan .

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An ultrasonic oscillation is applied in the neighborhood of one end of a guide member for supporting and guiding a powder, so that a transverse proceeding wave is generated in the guide member. The powder moves from the other end of the guide member toward a position of the applied ultrasonic oscillation under the action of this proceeding wave.

8 Claims, 9 Drawing Sheets

POWDER CONVEYING DEVICE

BACKGROUND OF THE INVENTION

1. Field of the Invention

The present invention relates to a powder conveying device.

2. Related Background Art

Conventionally, a screw is used as the device for conveying a powder, for example to convey the powder inside a pipe by rotating the screw provided within the pipe. Such a powder conveying device is frequently used as the device for conveying a toner from a toner hopper to a developing machine.

However, as the screw within the pipe must be rotated by a motor in the above conventional example, a problem exists in that the consumption power increases, and the sound of rotation might be relatively larger. Also, because of the constitution requiring the relatively complex screw and the motor, a larger space is necessary and the cost is increased.

If the clearance between an inner wall of pipe and the screw is large, the conveying efficiency is decreased. Conversely, if the clearance between the inner wall of pipe and the screw is small, the conveying efficiency is raised, but there us a problem in that the rotational torque of screw might be larger with the friction between the screw and the inner wall of pipe.

Furthermore, the powder may be degraded or broken due to the friction between the inner wall and the screw, or melt with the frictional heat. Generally, the powder can be easily charged with the friction, so that the powder is charged due to the friction with the screw during the conveyance, thereby sticking to the screw, and resulting in a problem that a conveyance failure may arise in severe cases.

Also, a conveying device is well known in which a large particle-like body is laid on a greatly vibrating diaphragm, inclined obliquely downward, to help it slide down such a slant plane with the oscillation. However, there is a disadvantage in that a large energy is necessary to cause the large oscillation of diaphragm, or a large oscillation sound might be generated.

Also, there is a device in which a fine particle-like body is conveyed by applying an air flow thereon or conveyed along with the air flow by entraining the powder into the air flow. However, such a device has a lower conveyance density of fine particle-like body due to the air fed in, resulting in a low efficiency conveying device.

Furthermore, in the field of a developing machine for developing an electrostatic latent image, there is widely used means for attaching electrostatically a charged toner (colored fine powder) to a carrying member such as a rotating roller and conveying the toner along with the rotation of the carrying member.

However, the charge polarity and amount of toner particle are variously changed, or the absolute quantity is easily varied and unstable, so that the density, gradation and line image reproducibility are unstable. Also, the quantity of particles sticking to the carrying member electrostatically is varied with the charge amount of the toner particle. That is, the humidity is changed, thereby varying the quantity of charged fine toner particles (thickness of toner layer) conveyed sticking electrostatically to the carrying member moving at constant speed, so that there is a disadvantage in that the quality of the image might be degraded.

Furthermore, conventionally, no mechanical driving portion could be eliminated, as resultant troubles easily arise due to the abrasion or oscillation load variation in this mechanical driving portion.

SUMMARY OF THE INVENTION

An object of the present invention is to provide an efficient powder conveying device having a small mechanical load.

Another object of the present invention is to provide a powder conveying device capable of conveying the powder with a low noise.

A further object of the present invention is to provide a powder conveying device capable of conveying the powder without applying a strong load onto the powder.

A still further object of the present invention is to provide a powder conveying device in which the conveying amount of charged powder has a low dependence on the environment.

To accomplish the above objects, in the present invention, the oscillation from an ultrasonic oscillation generator is applied to a guide member for supporting a powder and guiding its movement. By this application of oscillation, the proceeding wave is formed in the guide member. The powder is moved by this proceeding wave.

Other objects and features of the present invention will be made clear from the following description.

DESCRIPTION OF THE PREFERRED EMBODIMENTS

Figure 1A:
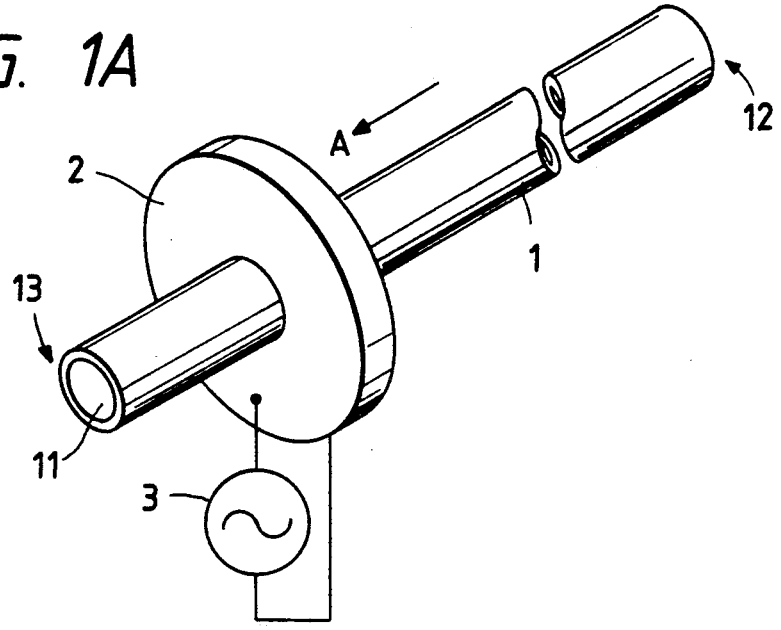
FIG. 1A is a perspective view of one example in the present invention.

In FIG. 1A, 1 is a longitudinal hollow pipe made of acrylic which is a powder guide member, with a powder (not shown) filling a hollow portion 11 thereof. In the neighborhood of an end portion 13 of the hollow pipe 1 downstream in a movement direction of the powder is fitted a piezoelectric element 2 for generation of the ultrasonic oscillation (oscillation generating means), to which an AC voltage is applied by an AC power source 3.

Figure 1B:
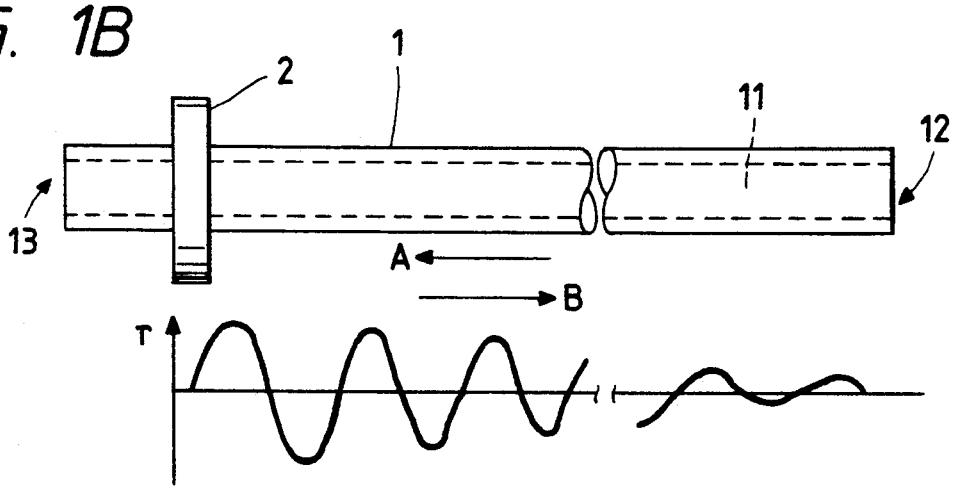
FIG. 1B is a side view of one example in the present invention and an explanation view of the proceeding wave.
Figure 2:
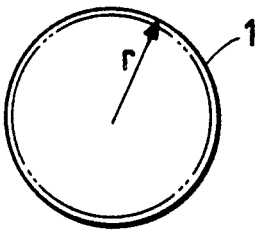
FIG. 2 is an explanation view of the oscillation in an outer wall of a powder guide pipe.

The piezoelectric element 2 can generate an ultrasonic oscillation such that a sectional outer wall of the hollow pipe 1 is oscillated in a radial direction (r direction) of the pipe, as shown by the two-dot chain line in FIG. 2. The hollow pipe 1 excited by the piezoelectric element 2 has a proceeding wave generated in a longitudinal direction of the pipe as shown in a lower stage of FIG. 1B.

The hollow pipe 1, which is made of acrylic, shows a relatively large attenuating property, in which the proceeding wave is attenuated in a direction from the element 2 toward an end portion 12, as shown in FIG. 1B. Accordingly, there is almost no reflected wave 12 at the end portion 12, so that the proceeding wave is not disturbed by the reflected wave.

With such a constitution, powder within the hollow pipe 1 is conveyed in a direction opposite to the direction B of the proceeding wave (A direction in FIGS. 1A and 1B).

Figure 3A:
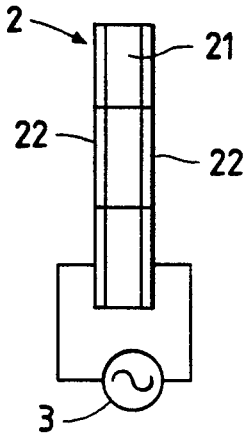
FIG. 3A is a side view of one example of an ultrasonic oscillation generator.
Figure 3B:
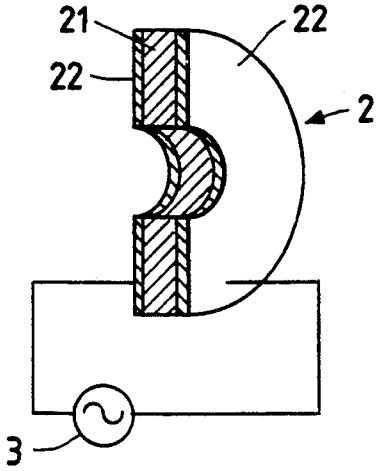
FIG. 3B is a perspective view thereof, partly broken away.

The above piezoelectric element 2 is of a type formed by sandwiching a ceramic 21 having a thickness of 2 mm, an outer diameter of 30 mm and an inner diameter of 15 mm with electrodes 22 on both sides, as shown in FIGS. 3A and 3B.

By applying a voltage across the electrodes 22 from the power source 3, the expansion and shrinkage oscillation is excited in a radial direction, i.e., in the r direction, due to an expansion force of the ceramic, with the ultrasonic oscillation being transmitted through the hollow pipe 1.

Based on a device of this example as above described, the following experiment was made.

The hollow acrylic pipe 1 used has an outer diameter of 15 mm and an inner diameter of 10 mm, with a powder supply hopper connected at the end portion 12. As the powder, a one-component magnetic toner (average particle diameter of 12 μm) was used. An AC voltage having a peak-to-peak value of 100 V and a frequency of 50 KHz was applied across the electrodes 22 by the AC power source 3. As a result of this experiment, the conveying force of this powder was 500 g/min.

Furthermore, a powder of glass beads (average particle diameter of 60 μm) of a two-component developer for development of an electrostatic latent image, a ferrite carrier (average particle diameter of 60 μm) of a two-component developer for development of an electrostatic latent image, or a nonmagnetic toner (average particle diameter of 8 μm), or a combination thereof, can be used to provide the same conveying force as the magnetic toner. Then, the conveying amount of powder varies in proportion to the voltage applied to the piezoelectric element, which makes it possible to control the conveying amount of the powder.

Also, the application time of the voltage can be varied in pulses. Though in the above example, the AC voltage having a peak-to-peak voltage of 100 V and a frequency of 50 KHz is applied, these values are calculated from a resonance mode which depends on the shape of the piezoelectric element, and the resonance frequency can be changed by varying the thickness and shape of the piezoelectric element.

Figure 4A:
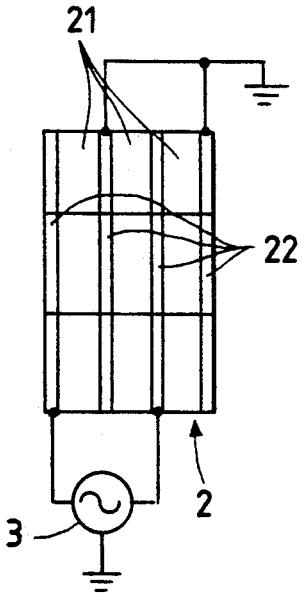
FIG. 4A is a side view of another example of the ultrasonic oscillation generator.
Figure 4B:
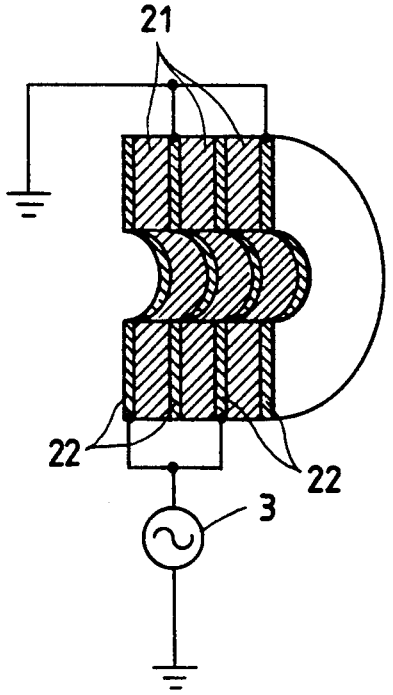
FIG. 4B is a perspective view thereof, partly broken away.
Figure 5A:
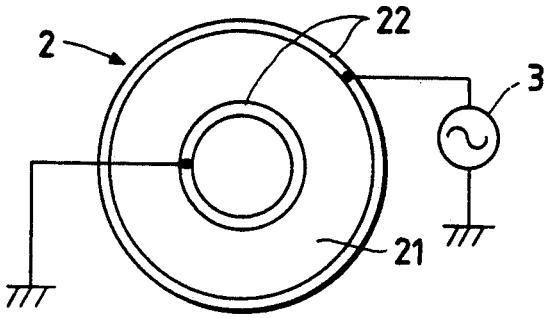
FIG. 5A is a side view of still another example of the ultrasonic oscillation generator.
Figure 5B:
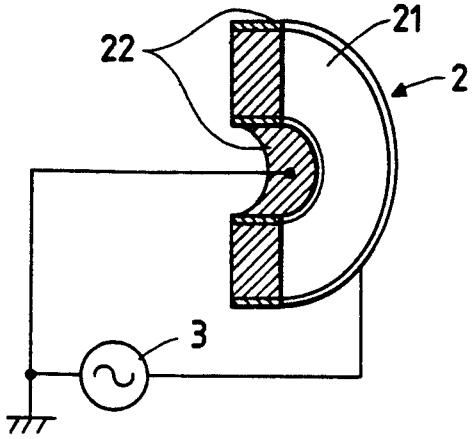
FIG. 5B is a perspective view thereof, partly broken away.

Also, in this example, the piezoelectric element 2 is only one layer, but the excited oscillation amount can be enlarged with a plurality of piezoelectric elements arranged in a sandwich type (multi-layer type), as shown in FIGS. 4A and 4B, and the proceeding wave propagating through the hollow pipe is larger, so that the powder conveying force is also increased. Also, the electrodes 22 can be provided in outer and inner peripheral portions of the piezoelectric element, as shown in FIGS. 5A and 5B.

Figure 6:
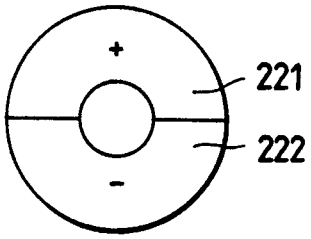
FIG. 6 is an explanation view of one example of the electrode division in the ultrasonic oscillation generator.
Figure 7:
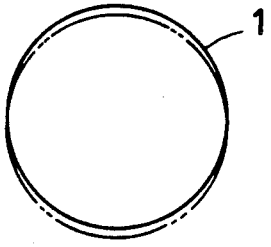
FIG. 7 is an explanation view of the pipe oscillation when using an electrode of FIG. 6.

Furthermore, various oscillation modes can be obtained by subdividing the electrode of the piezoelectric element and changing the polarity of the applied voltage. Specifically, the oscillation of a one-axis symmetrical type called a ((1,1)) mode as indicated by the two-dot chain line in FIG. 7 can be excited by an array of electrodes 221, 222 as shown in FIG. 6.

Figure 8:
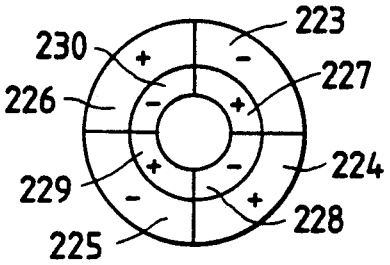
FIG. 8 is an explanation view of another example of the electrode division in the ultrasonic oscillation generator.
Figure 9:
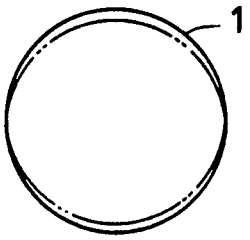
FIG. 9 is an explanation view of the pipe oscillation when using an electrode of FIG. 8.

Also, if the electrodes 223–230 are arranged as shown in FIG. 8, the parallel oscillation of the central axis called a ((2,1)) mode can be excited as indicated by the two-dot chain line in FIG. 9. Furthermore, a rotational mode of oscillation can be effected by shifting the phase of AC voltage applied to these electrodes by 90°.

In this way, many oscillation modes can be effected by further fractionizing the electrode and shifting the phase of the voltage applied to the respective electrodes. By making efficient use of these various modes, it is possible to select the optimal oscillation mode in accordance with the characteristics of various powders and obtain a sufficient conveying force in correspondence with respective powders. The mass, specific gravity, sliding property, stickiness, and charged property of powder are various, because the conveyance of powder significantly depends on the characteristics of the powder itself, even if the hollow pipe is the same.

In this example, an acrylic hollow pipe is used as the guide member, in which the amplitude of the proceeding wave generated by the ultrasonic oscillation given to a portion of the acrylic hollow pipe (connection with the element 2) is attenuated in a direction toward the end portion 12 because the acrylic hollow pipe itself can absorb the oscillation. And the powder moves in a direction A opposite to the attenuating direction of the proceeding wave.

The powder guide pipe 1 may be a material having a large attenuation of oscillation, or can be used by pasting a material having a large attenuation of oscillation to a part of a material having a small attenuation of oscillation, e.g., a metallic pipe, or increasing the attenuation by grooving the metallic pipe itself.

As previously described, the present invention is characterized in that the reflected wave of the incident wave at the end portion 12 is prevented from overlapping with the proceeding wave and impeding the conveyance of the powder.

Table 1 shows the results of an experiment conducted by changing the length of pipe used from 10 cm to 1 m, where (a) is an acrylic hollow pipe (with a diameter of 20 mm), (b) is an acrylic hollow pipe (with a diameter of 10 mm), and (c) is an aluminum hollow pipe with a diameter of 18 mm covered with acrylic having a thickness of 1 mm, which has a diameter of 20 mm.

In Table 1, the conveying amount of powder is increased in the order of ×, Δ, ○ and ◎. Δ indicates that the powder conveying amount is slightly insufficient, and × indicates that the powder conveying amount is very small.

The experiment indicated that the same results could be obtained irrespective of the length, if the ratio of the amplitude at the end portion 12 to the incident amplitude at the connection position of the element 2 was taken as a parameter.

Also, from these results of the experiment, it was found that the oscillation amplitude of the powder guide member 1 excited by the oscillation generator means 2 would be desirably less than or equal to ½ of the amplitude of incidence at the end portion 12. This is to suppress the influence of the reflected wave at the end portion 12.

The material of the pipe 1 is suitably a synthetic resin such as acrylic, nylon, POM, ABS, polypropylene or polystyrene, because of its large attenuation of oscillation.

TABLE 1

| End amplitude/ Incidence amplitude | 0.1 | 0.2 | 0.3 | 0.4 | 0.5 | 0.6 | 0.7 | 0.8 |
|---|---|---|---|---|---|---|---|---|
| (a) Acrylic hollow pipe (diameter of 20 mm) | ○ | ◎ | ◎ | ◎ | ○ | Δ | x | x |
| (b) Acrylic hollow pipe (diameter of 10 mm) | ○ | ◎ | ◎ | ◎ | ○ | Δ | x | x |
| (c) Aluminum (diameter of 18 mm) + acrylic pasted (thickness of 2 mm) | ○ | ◎ | ◎ | ◎ | ○ | Δ | x | x |

Note that to change the ratio of the amplitude of the end portion to the amplitude of incidence as shown in Table 1, it is merely necessary to change the length between the connection position of the pipe 1 with the ultrasonic oscillation generating means 2 and the end portion 12, in which the above length can be determined experimentally to obtain a desired ratio.

Also, the oscillation generating means 2 is connected to the guide member 11 at a position closer to the end portion 13, rather than the end portion 12, or the oscillation generating means 2 is connected to the guide member 1 in the neighborhood of the end portion 13. Between the connecting position of the oscillation generating means 2 to the guide member 1 and the end portion 13, a proceeding wave is generated in a direction opposite to that of the proceeding wave produced between the above connecting position and the end portion 12. This proceeding wave is called a "reverse proceeding wave" for convenience. This reverse proceeding wave exerts a force on the powder in a reverse direction to the direction of arrow A as shown in FIG. 1B. Accordingly, the length between the above connecting position and the end portion 13 is such a length that the powder moving from the side of the end portion 12 in the direction of arrow A can move beyond the above connecting position to the end portion 13, owing to its inertial force, and such a length can be determined experimentally.

Figure 10:
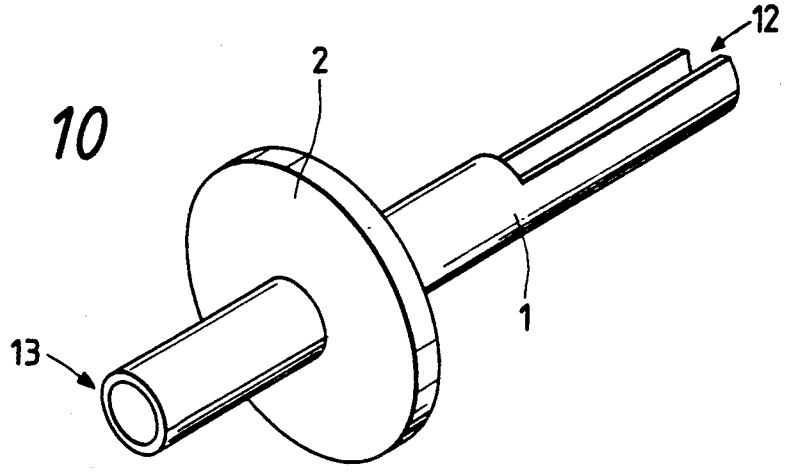
FIG. 10 is an explanation view of another example in the present invention.

The example of FIG. 10 is different from that of FIG. 1 in that the guide member 1 is used by cutting away a part of the hollow pipe of FIG. 1. Also, in this example, the guide member is made of acrylic.

The conveyance principle is the same as in the example of FIG. 1, in which the voltage is applied from the AC power source 3 to the piezoelectric element 2 to attenuate the proceeding wave and to convey the powder. This has an advantage in that, as an upper portion of the hollow pipe is partially open, the powder can be simply replenished through this grooved opening portion.

Figure 11:
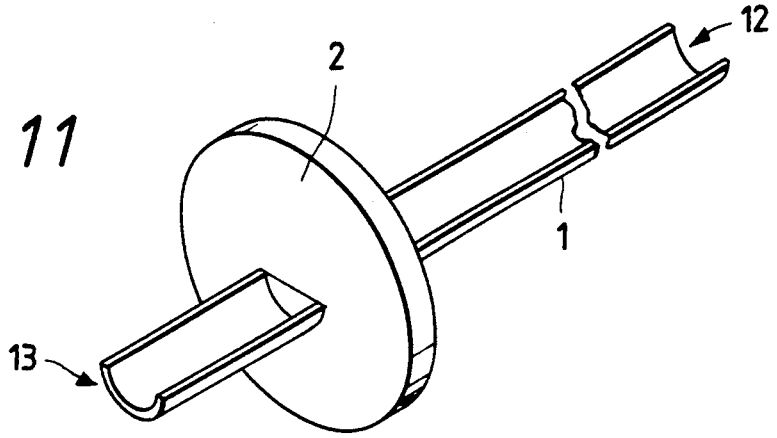
FIG. 11 is an explanation view of still another example in the present invention.

Also, the same effects can be exhibited with the powder guide member 1 formed as a trough, as shown in FIG. 11.

Figure 12:
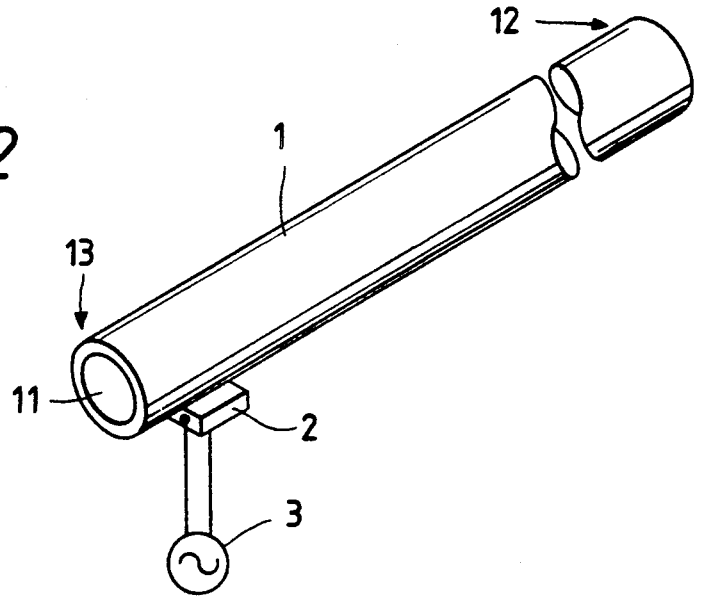
FIG. 12 is an explanation view of still another example in the present invention.
Figure 13A:
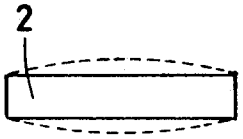
FIG. 13A is an explanation view of one example of the oscillation of a piezoelectric element as shown in FIG. 12.
Figure 13B:
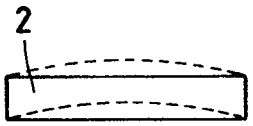
FIG. 13B is an explanation view of another example for the oscillation of the piezoelectric element as shown in FIG. 12.

The example of FIG. 12 differs from that of FIG. 1 in that the piezoelectric element 2 is secured to a lower portion of the hollow pipe 1. This is a device for conveying the powder in such a way as to ultrasonically oscillate a plate-like piezoelectric element such as a laminated piezoelectric element as shown in FIG. 13A or 13B, and to produce the proceeding wave from a part of the hollow pipe by applying the ultrasonic oscillation thereto, whereby a sufficient conveying force can be generated like in the other examples.

With such a constitution, conveyance of powder can be fulfilled in a simple and compact manner, which is favorable for the exchange of pipe and the cost.

Figure 14:
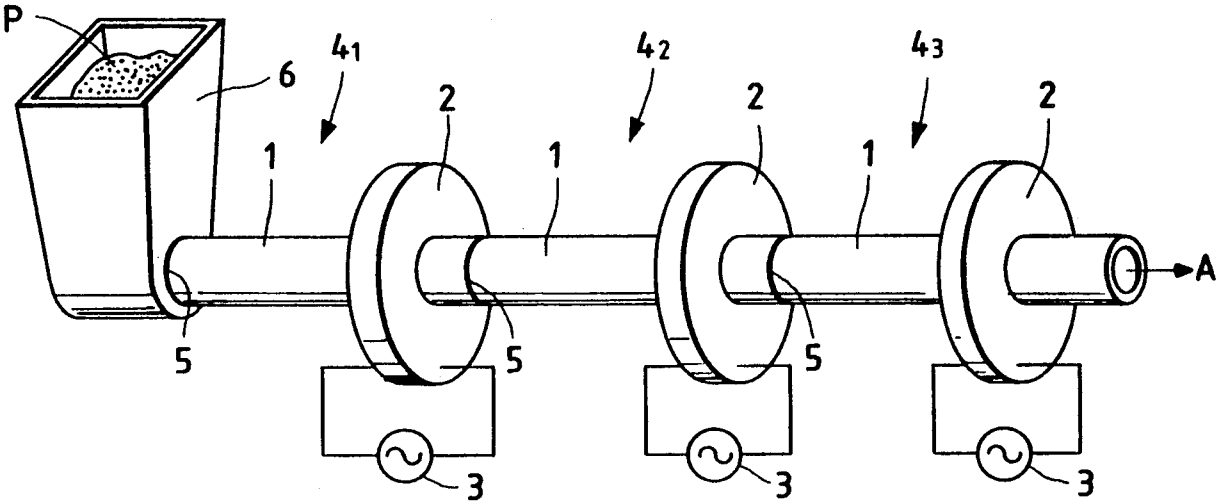
FIG. 14 is an explanation view of still another example in the present invention.

The example of FIG. 14 is one in which a plurality of conveying apparatuses as described in the above examples are connected. In FIG. 14, 6 is a powder supply hopper in which the powder P is contained.

Each conveying unit $4_1$, $4_2$ or $4_3$ is the same as that shown in FIG. 1, with the guide member 2 of each conveying unit connected via an oscillation absorbing member 5. This is to prevent the proceeding wave of one of two adjacent conveying units from interfering with the other proceeding wave and disturbing the conveyance of powder.

Figures 15A, 15B, 15C:
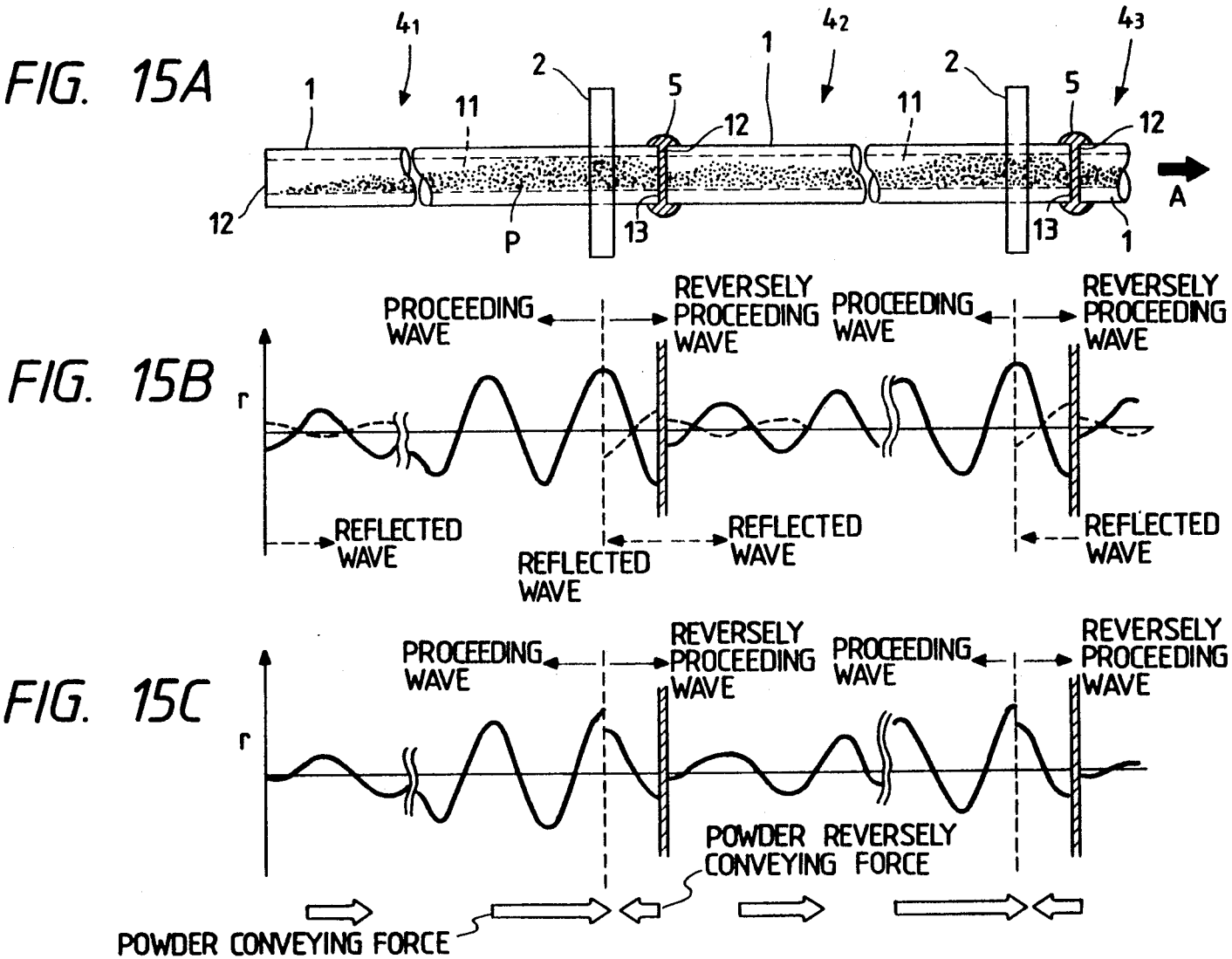
FIG. 15A is a side view of essential parts in the example of FIG. 14.
FIG. 15B is an explanation view of the proceeding wave, the reflected wave, etc., as shown in FIG. 15A.
FIG. 15C is an explanation view of a composite wave for the wave of FIG. 15B.

That is, the proceeding wave propagating through the hollow pipe 1 is attenuated by the oscillation absorbing member 5 as shown in FIG. 15B, and so can not propagate to adjacent hollow pipe 1. FIG. 15C shows the oscillation of a proceeding wave excited in the hollow pipe 2 after composition of respective proceeding waves.

With the oscillation absorbing member 5 interposed between the end portion 13 of one pipe 1 and the end portion 12 of the other pipe 1, the influence of a reversely proceeding wave can be suppressed to a small degree, so that it is possible to have the magnitude and the direction of powder conveying force as shown in FIG. 15C.

As will be clear from this, an effective powder conveying force is exerted in a fixed direction, so that the powder is powerfully conveyed in the direction of arrow A as shown in FIG. 15A.

Figure 16:
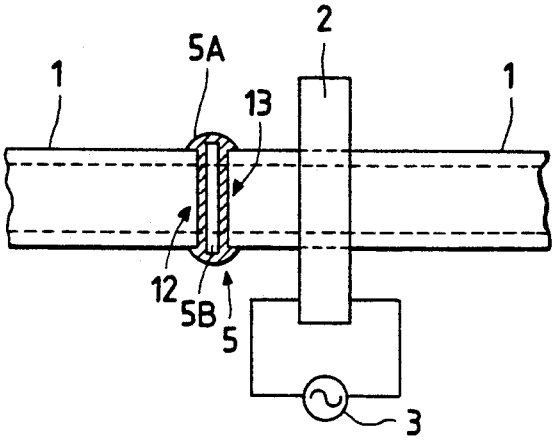
FIG. 16 is an explanation view of one example of a connection of two guide pipes.

FIG. 16 shows one example of the oscillation absorbing member 5. This oscillation absorbing member 5 is constituted of a vibration-proofing rubber (NBR) 5B and a silicon adhesive 5A, serving to connect the hollow acrylic pipes.

Thereby, the powder could be conveyed smoothly along a long distance of 2 mm, without cloggings. Using a one-component magnetic toner (with an average particle diameter of 12 μm) as the powder, the powder conveying force was 500 g/min.

Furthermore, the powder of glass beads (average particle diameter of 60 μm), a ferrite carrier (average particle diameter of 60 μm) and a nonmagnetic toner (average particle diameter of 8 μm), or a combination thereof, can be used to provide the same conveying force as the magnetic toner. Then, the conveying amount of powder was varied in proportion to the voltage applied to the piezoelectric element, and the control for the conveying amount of the powder could be enabled.

By the way, in this example, an AC voltage with the same phase and the same voltage (a peak-to-peak voltage of 100 V and a frequency of 50 KHz) was continuously applied to the piezoelectric element of each unit, with each piezoelectric element being made an independent event by the oscillation absorbing member, whereby even if the phase, application time and value for the voltage applied to a voltage element may be changed, the powder conveying force with the voltage element can be controlled without exerting the influence on the other voltage elements.

The oscillation absorbing member 5 is optimally NBR, urethane rubber, silicon rubber EKDM, gel resin, or silicon rubber adhesive, whereby the oscillation of the proceeding wave can be absorbed almost completely by reducing the hardness of rubber. A further experiment indicated that if the oscillation absorbing ratio of the member 5 was more than or equal to 50%, the amplitude of the proceeding wave propagating through the oscillation absorbing member 5 could be attenuated to ½ or less, whereby the powder could be smoothly conveyed without any influence on the proceeding wave produced from adjacent hollow pipes and piezoelectric elements.

Figure 17:
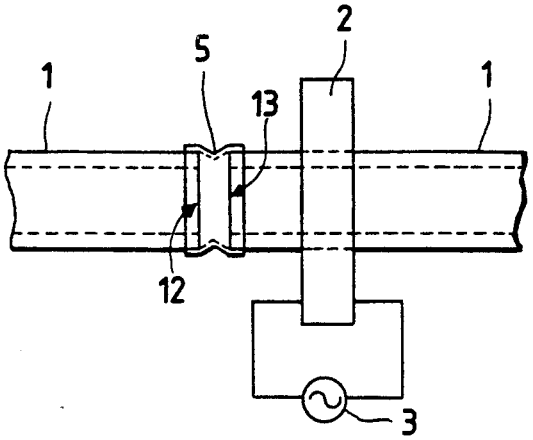
FIG. 17 is an explanation view of another example of the connection of two guide pipes.

The oscillation absorbing member 5 as shown in FIG. 17 is a rubber tube, in which adjacent pipes 1 are connected by this rubber tube 5. In FIG. 17, other than the rubber tube, a tube made of for example, nylon, polypropylene, vinyl chloride, or a soft resin such as PTFE or PFA, can be used as the oscillation absorbing member 5.

Note that the powder conveying device as shown in FIGS. 10, 11 and 12 can be connected in plural number as shown in FIG. 14.

An example as described below is the same as each example described previously in that the ultrasonic flexural oscillation is applied to the powder guide member at a position downstream in a conveying direction of the powder, thereby producing a proceeding transverse wave travelling upstream in the conveying direction in that member and conveying the powder with the proceeding wave. However, the following example is one of selecting and conveying powder particles properly charged among the powder. That is, properly charged powder particles which are adequately adsorbed electrostatically to the guide member can move in a direction toward the connecting position with the ultrasonic oscillation generating means.

Thereby, with a small amount of energy, charged particles can be efficiently conveyed at high density, and can be stably conveyed in a silent manner without any dependence of the conveying amount of charged particles upon the environment. Accordingly, when a developing device for an electrostatic latent image is used, developer particles always holding a desired amount of charge and polarity are mainly conveyed, so that the image quality of the developed image can be made stable.

Figure 18:
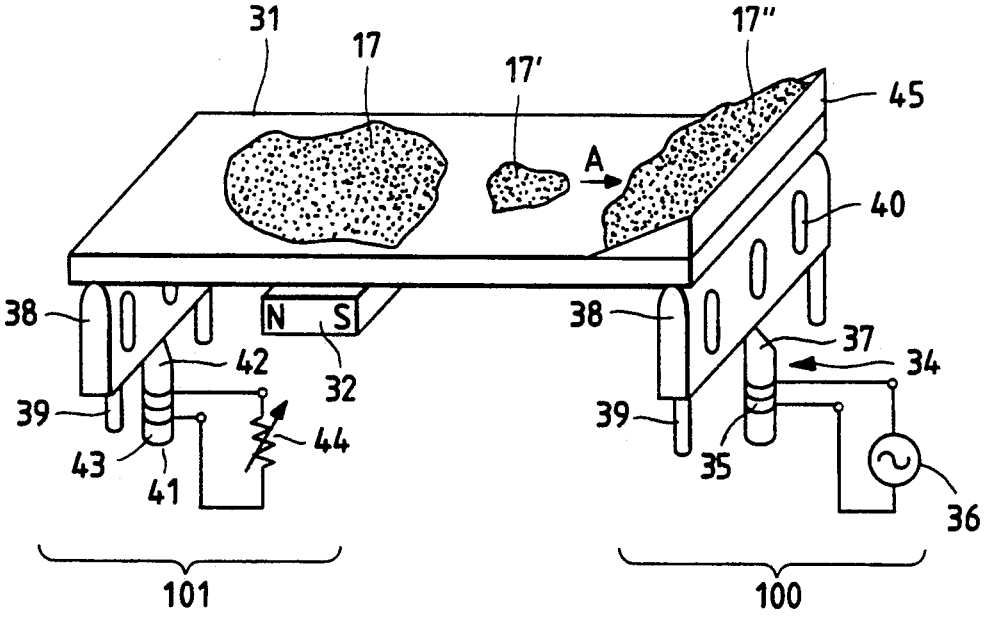
FIG. 18 is an explanation view of another example in the present invention.

In FIG. 18, 31 is the guide member, with a magnet 32 of magnetic field generating means attached to its lower face. Also, 34 is an ultrasonic excitation means, which is constituted of a piezoelectric oscillation element 35, a high frequency power source 36 for driving it and a hone 37. 38 is transmission means for transmitting the oscillation with the ultrasonic excitation means 34 to one end of a nonmagnetic plate member 31 such as a plate-like stainless steel or plate-like aluminum uniformly with respect to the width direction of the member 31. Slender holes 40 are designed in such a way as to provide different shaped holes at positions of the transmission means 38 corresponding to a central portion and both end portions in the width direction of the member 31, and to transmit the oscillation with the ultrasonic excitation means 34 to the plate-like member 31 uniformly with respect to the width direction of the member 31. 39 is an additive oscillator provided behind the transmission means 38 as shown in FIG. 18, for adjusting the oscillation so that the oscillation with the ultrasonic excitation means 34 can be transmitted uniformly in the width direction of the member 31. The above constitution is an ultrasonic generating device 100.

Next, a sound wave absorbing device 101 will be described.

41 is a mechano-electrical converting means for converting the mechanical oscillation to an electrical energy. The transmission means 38 and the additive oscillator 39 are provided on a side opposite to the side of the guide member 31 connected to the ultrasonic generating device 100, as above described, with the mechanical-electrical converting means 41 being provided behind the transmission means 38. 42 is a hone like 37, and 43 is a piezoelectric element. 44 is an electrical resistive load (about 3 kω) for absorbing the mechanical oscillation as energy, by converting the mechanical energy to electrical energy with the piezoelectric element 43, and converting that electrical energy to thermal energy with this electrical resistive lead. The mechanical-electrical converting means 41 is constituted of the hone 42, the piezoelectric element 43 and the electrical resistive load 44. The purpose of them is to receive the mechanical oscillation propagating through the guide member 31 with the transmission means 38, and further to absorb the mechanical oscillation as the energy with the mechanical-electrical converting means 41.

45 is a member for withdrawing the magnetic toner 17 (resin powder having a particle diameter of several to several tens μm having fine magnetic substances dispersed inside) of charged particles conveyed in the direction of arrow A by the guide member 31.

In this example, the ultrasonic excitation is caused by transmitting the oscillation with the ultrasonic excitation means 34 through the transmission means 38 to one end side of the plate-like guide member 31, so that the proceeding transverse wave is given to the member 31.

In the device of this example as above described, first, a large amount of magnetic toner is laid on the guide member 1 in a magnetic field near the magnet 32. Next, if an oscillation of 20 to 30 kHz is transmitted to the member 31 with the ultrasonic generating means 100, the toner 17 trapped by the magnetic force and the toner 17' moving to the right can be observed. The toner 17' can be consecutively conveyed without intermittence because of its small amount. The toner 17' further moves to the right, gradually forming the toner accumulation 17''.

A comparison between the charge amount of toner accumulation 17 near the magnet 3 and that of toner 17'' within a member 45, indicated that the toner 17 was about 0 μc/g, while the toner 17'' was about 10 to 20 μc/g.

As a magnet has a more powerful magnetic force, there was a tendency that the charge amount of the toner 17'' was larger. That is, it is considered that particles appropriately charged with the friction between the toner particles themselves and between the toner particles and the sound wave propagating member 1 within the toner accumulation 17 are conveyed with the action of the proceeding wave by obtaining the adsorptive power with the reflection force against the member 1.

On the other hand, the electrostatic adsorptive power of toner particles not charged in a proper amount to the guide member 31 is weak, so that the toner particles are restrained by the magnetic force of the magnet 32 even if they are subjected to the action of the proceeding wave, and can not move in the direction of arrow A.

Also, the adsorptive power of particles to the member 31 governing the conveying force of particles is not good if it is too strong or weak, and an excellent condition must be held. In such a case, the absorptive power can be adjusted, for example, by applying a bias voltage to the sound wave propagating member 31.

Figure 19:
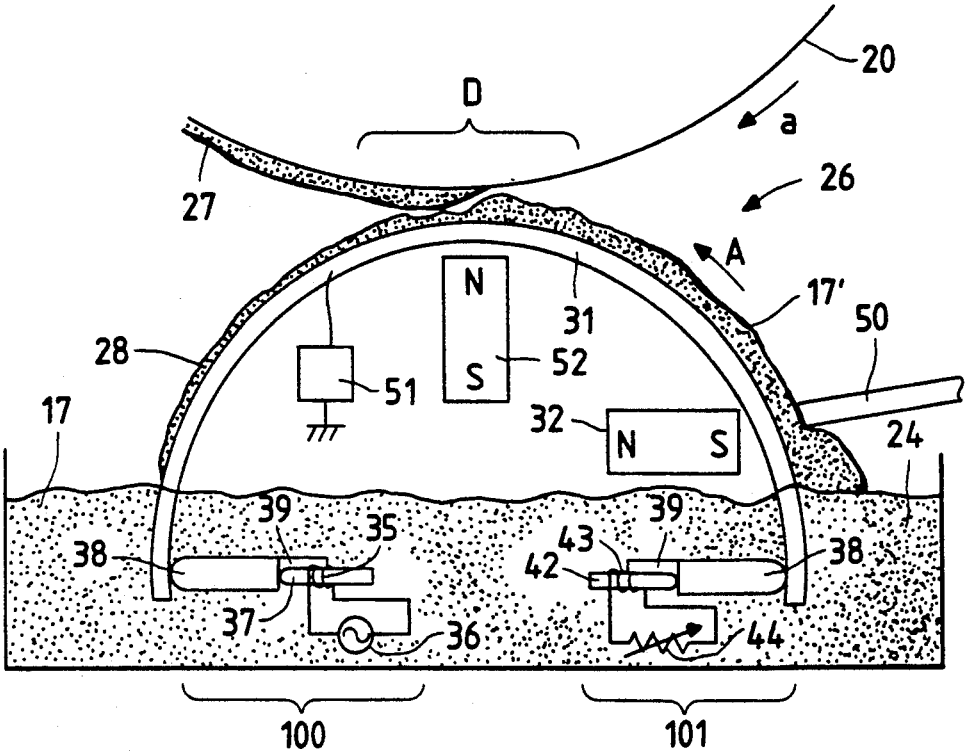
FIG. 19 is an explanation view of still another example in the present invention.

FIG. 19 is a cross-sectional view of a developing device in an image forming device using an electrophotographing, system.

A photosensitive drum 20 on which an electrostatic latent image is laid is rotated in a direction of arrow a, and passes through a developing area D. On the other hand, on the side of the developing device 26, only sufficiently charged magnetic toner 17 (resin into which magnetic powder is dispersed, with an average particle diameter of 10 to 20 μm, and a high charged property) among the toner reserved in a container 24 is conveyed in a direction of arrow A on a semi-circular toner conveying guide plate 31 (fixed) against a magnetic force of the magnet 32, in the same principle as the example of FIG. 18. Also, the amount of toner 17' conveyed to the developing area D is adjusted by a regulating blade 50. Note that this toner conveying plate 32 has a well-known developing bias power source 51 connected, with an electric field pattern formed by this bias voltage and the electrostatic latent image on the photosensitive drum 20 in the D portion. The charged toner 17' conveyed to the D portion is transferred from the toner conveying guide plate 31 to the photosensitive drum 20 in accordance with the pattern, thereby to create a toner image 27. This toner image is then transferred to a transfer paper, which passes through a fixing device (not shown), and the copy is completed. Undeveloped toner 28 remaining on the toner conveying guide plate 31 is further conveyed to return to the container 24.

Note that if a magnet 52 forming the magnetic field on the developing area D within a conveying plate 22 is provided, fogging is prevented, and if the regulating blade 50 of a magnetic material is disposed in the magnetic field of the magnet 32, the regulating effect of toner can be enhanced.

In the above examples, by using the magnet 32 such as an electromagnet and making the magnetic force variable, the charge amount of toner to be conveyed can be controlled. That is, as the reaction force against the ultrasonic conveying force is increased with increasing magnetic force, the toner may not be conveyed in a desired direction unless the charge amount of toner is large.

However, when the developing device as described in the example of FIG. 19 is used, the charge polarity of the toner is important in addition the charge amount. Often, with the friction between particles, particles charged with a polarity opposite to that for developing the latent image may be produced, whereby there is a fear that troubles such as fogging may be caused. To prevent this, it is necessary to select and convey only particles of desired charge polarity to the developing area D. Thus, the following attempts were made using the present invention.

Figure 20:
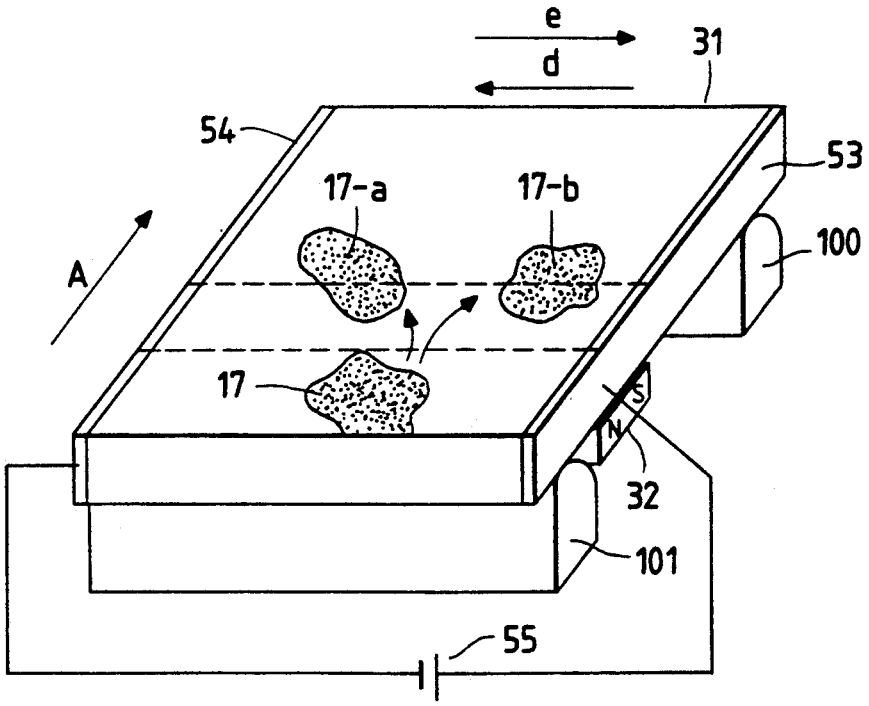
FIG. 20 is an explanation view of still another example in the present invention.

FIG. 20 shows a guide member 31 made of a semiconductor to which the electric field is applied in a direction perpendicular to the travelling direction of the proceeding wave. That is, the potential slope on and within the guide member 31 by the electrodes 53, 54 and a DC power source 55 is produced to convey the charged toner 17 therein. Then, the toner is subject to the ultrasonic conveying force in a A direction, and the force in the d or e direction depending on whether its polarity is positive or negative, so that the magnetic toner 17 is separated into **17-*a* (positive polarity toner) and 17-*b*** (negative polarity toner). In this way, an electrostatic latent image can be developed using toner with a desired polarity from among two groups of separated toner.

Figure 21:
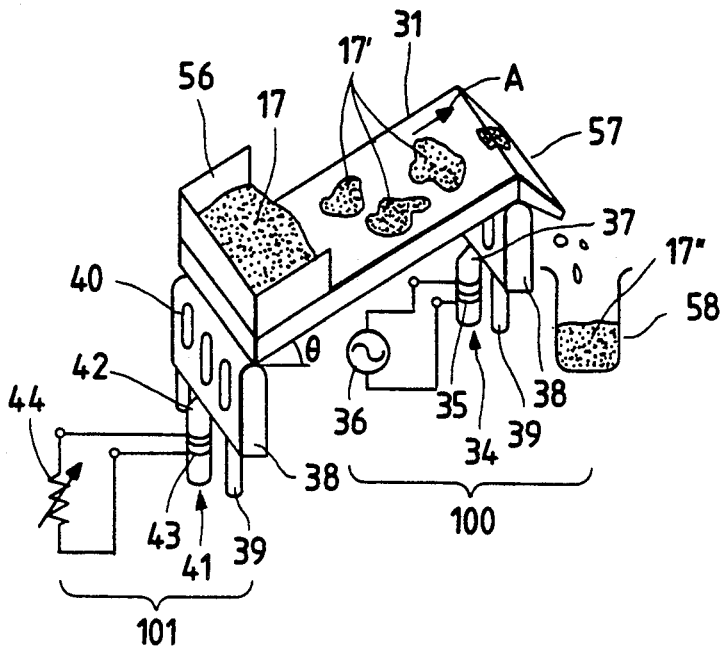
FIG. 21 is an explanation view of still another example in the present invention.

The device as shown in FIGS. 18, 19 and 20 can not be used for nonmagnetic toner. FIG. 21 shows a device using a nonmagnetic toner.

In FIG. 21, a plate-like guide member 31 has a guide plate inclined upward by an angle $\theta$ with respect to the horizontal line in a toner travelling direction. 56 is a holding member of the toner 17, and 57 is a down guide plate for dropping the toner 17' travelling thereto onto a toner receiver 58.

The ultrasonic oscillator 100 is driven, the toner 17' electrostatically adsorbed to the guide member 31 with an appropriate force because of the adequate charge amount among the toner 17 held by the holding member 56 goes up a slope in a direction of arrow A and is withdrawn via the guide 57 into the toner receiver 58.

At a position of the holding member 56, the toner is charged due to friction with the guide member 31 and between particles toner. Toner having a weak adsorptive power to the guide member 31 because of insufficient amount of charge can not go up the slope because the gravity force overcomes the driving force of the proceeding wave.

With a larger upward angle $\theta$ of the slope, only the toner having a larger amount of charge can go up the slope.

The adsorptive power of particles to the member 31 governing the conveying force of particles is not good if it is too strong or weak, and it is necessary to maintain an excellent state. In such a case, it is necessary to adjust the adsorptive power, for example, by applying a bias voltage to the member 31.

Figure 22:
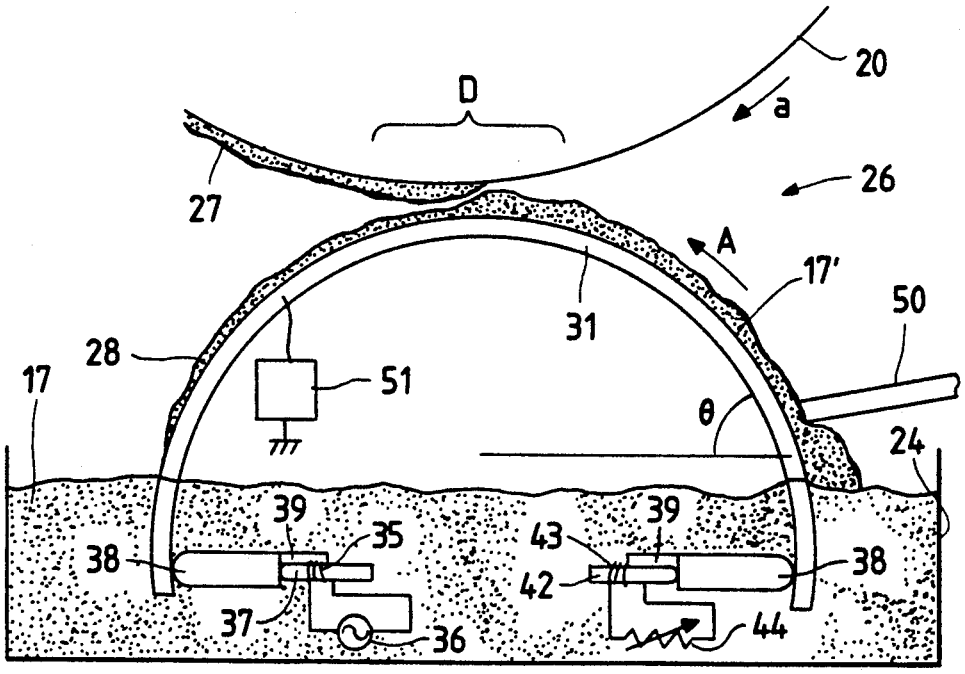
FIG. 22 is an explanation view of still another example in the present invention.

Shown in FIG. 22 is a developing device of electrostatic latent image as in FIG. 19, but the magnets 32, 52 as shown in FIG. 19 are not used because a nonmagnetic one-component developer (nonmagnetic toner) is used. Other than that, it is the same as the device of FIG. 19.

In FIG. 22, the developing area D is set near a top portion of semi-circular guide member 31, but the developing area D may be opposed to an upward or downward slanting area of the guide member 31.

Note that the example of FIG. 19 uses the semi-circular guide member 31 as in FIG. 22. Accordingly, the example of FIG. 19 uses the magnetic toner, but the same effects may be exhibited as described in FIG. 21.

Also, in FIG. 21, if the guide member 31 is a semiconductor and electrodes 53, 54 and the power source 55 are provided as described in FIG. 20, the toner travelling with the proceeding wave can be separated into two groups of positive polarity charged toner and negative polarity charged toner, as described in FIG. 20.

In the above example, by making variable the angle of upward slope 8 of the plate for conveying particles by means of a screw or the like, the charge amount of toner to be conveyed can be controlled.

It should be understood that the present invention can be applied to not only a conveying device of developer for developing the electrostatic latent image but also that of other particles.

What is claimed is:

1. A powder conveying device comprising:

a guide member for supporting powder and for guiding a movement of the powder; and ultrasonic oscillation generating means, connected to said guide member at a position closer to an end portion on the downstream side in a travelling direction of the powder than an end portion of the upstream side in the travelling direction of the powder, for applying an oscillation to said guide member;

wherein said guide member is formed with a proceeding wave attenuating from a connecting position with said ultrasonic oscillation generating means toward the upstream side in the travelling direction of the powder to thereby move the powder.

2. The powder conveying device according to claim 1, wherein an amplitude of the proceeding wave at an end portion of said guide member upstream in the travelling direction of the powder is less than or equal to half of an amplitude of the proceeding wave at a connecting position with said ultrasonic oscillation generating means.

3. The powder conveying device according to claim 2, wherein said guide member is made of a synthetic resin.

4. The powder conveying device according to claim 3, wherein said guide member is shaped as a pipe, and said ultrasonic oscillation generating means applies the oscillation to said pipe shaped guide member in its radial direction.

5. A powder conveying device comprising:

first and second guide members for supporting powder and for guiding a movement of the powder;

first ultrasonic oscillation generating means connected to said first guide member at a position closer to an end portion on the downstream side in a travelling direction of the powder than an end portion on the upstream side in the travelling direction of the powder, for applying an oscillation to said first guide member;

second ultrasonic oscillation generating means connected to said second guide member at a position closer to an end portion on the downstream side in a travelling direction of the powder than an end portion on the upstream side in the travelling direction of the powder, for applying an oscillation to said second guide member; and an oscillation absorbing member for connecting an end portion of said first guide member on the downstream side in the travelling direction of the powder and an end portion of said second guide member on the upstream side in the travelling direction of the powder;

wherein each of said first and second guide members is formed with a proceeding wave attenuating from a connecting position with a respective ultrasonic oscillation generating means toward the upstream side in the travelling direction of the powder, thereby to move the powder.

6. The powder conveying device according to claim 5, wherein an amplitude of the respective proceeding wave at the end portions of said first and second guide members on the upstream side in the travelling direction of the powder is less than or equal to half of an amplitude of the proceeding wave at the connecting positions with said respective ultrasonic oscillation generating means.

7. The powder conveying device according to claim 6, wherein at least one of said first and second guide members is made of a synthetic resin.

8. The powder conveying device according to claim 7, wherein said at least one guide member is shaped as a pipe, and the respective ultrasonic oscillation generating means applies the oscillation to said pipe shaped guide member in its radial direction.

* * * * *

UNITED STATES PATENT AND TRADEMARK OFFICE

CERTIFICATE OF CORRECTION

PATENT NO. : 5,270,484

DATED : Dec. 14, 1993

INVENTOR(S) : Hiroaki Tsuchiya, et al

It is certified that error appears in the above-indentified patent and that said Letters Patent is hereby corrected as shown below:

COLUMN 1

Line 10, "example" should read --example,--.
Line 17, "consumption" should read --consumption of--.
Line 27, "us" should read --is--.
Line 59, "particle" should read --particles--.
Line 65, "particle." should read --particles.--.

COLUMN 4

Line 48, "axis" should read --axis,--.
Line 49, "mode" should read --mode,--.

COLUMN 9

Line 41, "absorptive" should read --adsorptive--.
Line 46, "photographing," should read --photographing--.

COLUMN 10

Line 38, "a" should read --an--.
Line 64, "particles toner." should read --toner particles.--.

COLUMN 11

Line 31, "slope 8" should read --slope $\theta$--.

UNITED STATES PATENT AND TRADEMARK OFFICE

CERTIFICATE OF CORRECTION

PATENT NO. : 5,270,484

DATED : Dec. 14, 1993

INVENTOR(S) : Hiroaki Tsuchiya, et al

It is certified that error appears in the above-indentified patent and that said Letters Patent is hereby corrected as shown below:

COLUMN 12

Line 10, "pipe shaped" should read --pipe-shaped--.

Line 55, "pipe shaped" should read --pipe-shaped--.

Signed and Sealed this

Fifth Day of July, 1994

Bruce Lehman

*Attest:*

BRUCE LEHMAN

*Attesting Officer*

*Commissioner of Patents and Trademarks*